US010895237B1

(12) United States Patent
Samie et al.

(10) Patent No.: US 10,895,237 B1
(45) Date of Patent: Jan. 19, 2021

(54) ELECTRIC STARTER SYSTEM WITH LATCH MECHANISM FOR PINION PRE-ENGAGEMENT CONTROL

(71) Applicant: GM Global Technology Operations LLC, Detroit, MI (US)

(72) Inventors: Farzad Samie, Franklin, MI (US); Chunhao J. Lee, Troy, MI (US); Lei Hao, Troy, MI (US); Chandra S. Namuduri, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/511,860

(22) Filed: Jul. 15, 2019

(51) Int. Cl.
*F02N 11/08* (2006.01)

(52) U.S. Cl.
CPC ..... *F02N 11/0855* (2013.01)

(58) Field of Classification Search
CPC ..... F02N 11/0855; F02N 11/0851
See application file for complete search history.

(56) References Cited

U.S. PATENT DOCUMENTS 7,373,908 B2 5/2008 Rizoulis et al.
8,561,588 B2 10/2013 Reynolds et al.
2008/0162007 A1* 7/2008 Ishii ..... F02N 11/087 701/54
2011/0056450 A1* 3/2011 Notani ..... F02N 11/0855 123/179.4
2012/0256523 A1* 10/2012 Fulton ..... F02N 11/02 310/68 D
2013/0283938 A1* 10/2013 Palfai ..... F02N 11/0844 74/6
2013/0319360 A1* 12/2013 Aoyagi ..... F02N 11/106 123/179.3
2014/0260792 A1* 9/2014 Bradfield ..... F02N 15/06 74/7 A
2014/0336909 A1* 11/2014 Doit ..... F02N 11/0855 701/113
2017/0334422 A1 11/2017 Namuduri et al.
2018/0058411 A1* 3/2018 Archer ..... F16D 43/14
2019/0032620 A1* 1/2019 Baba ..... F16H 1/06

* cited by examiner

*Primary Examiner* — George C Jin
(74) *Attorney, Agent, or Firm* — Cantor Colburn LLP

(57) ABSTRACT

An electric starter system is disclosed for use with an engine having a flywheel. The electric starter system includes a pinion gear and a solenoid device coupled to the pinion gear. The solenoid device is movable between a pre-engaged position when the pinion gear is moved into engagement with the flywheel and a disengaged position when the pinion gear is disengaged from the flywheel. A brushless starter motor is selectively connectable to the flywheel of the engine via the pinion gear during a requested engine start event. A latch mechanism is selectively engageable with the solenoid device. The latch mechanism is moveable between a latched position in which the solenoid device is mechanically held in the pre-engaged position and an unlatched position in which the solenoid device is released for movement to the disengaged position.

18 Claims, 5 Drawing Sheets

ELECTRIC STARTER SYSTEM WITH LATCH MECHANISM FOR PINION PRE-ENGAGEMENT CONTROL

INTRODUCTION

The subject disclosure relates to an electric starter system with a latch mechanism for pinion pre-engagement control.

An engine generates torque in response to an acceleration request. When the engine is used as part of a powertrain, the generated torque is transmitted to a coupled load via a transmission. In some powertrain configurations, a rotor of an electric machine is selectively coupled to a flywheel of the engine, e.g., via a ring gear. Motor torque from the electric machine is used to accelerate the engine to a threshold speed. Torque assist from the electric machine may be used to support the engine's cranking and starting function during a requested engine auto-start event, with the electric machine in such an application typically referred to as a starter motor. An electric starter system with the starter motor needs to be engaged with the engine prior to each start. A solenoid device may be used to pre-engage a pinion gear to the flywheel to reduce start time and noise prior to spinning the engine. However, the solenoid device continuously consumes power during the pre-engagement and cannot be used for a key start.

Accordingly, it is desirable to provide an improved electric starter system for use with an engine that can pre-engage the pinion gear to the flywheel while eliminating ongoing power consumption to the solenoid device and enabling a key start.

SUMMARY

In one exemplary embodiment, an electric starter system for use with an engine having a flywheel is disclosed herein. The electric starter system includes a pinion gear and a solenoid device coupled to the pinion gear. The solenoid device is movable between a pre-engaged position when the pinion gear is moved into engagement with the flywheel, and a disengaged position when the pinion gear is disengaged from the flywheel. A brushless starter motor is selectively connectable to the flywheel of the engine via the pinion gear during a requested engine start event. A latch mechanism is selectively engageable with the solenoid device. The latch mechanism is moveable between a latched position in which the solenoid device is mechanically held in the pre-engaged position and an unlatched position in which the solenoid device is released for movement to the disengaged position. When the latch mechanism is in the latched position, the solenoid device is mechanically held in the pre-engaged position with the pinion gear engaging the flywheel and ready to start the engine.

In accordance with another exemplary embodiment, the solenoid device of the electric starter system includes a plunger and a solenoid biasing member for biasing the plunger towards a disengaged position. When the latch mechanism is in the unlatched position, the solenoid biasing member urges the solenoid device to the disengaged position.

In yet another exemplary embodiment of the electric starter system, the latch mechanism includes a latch solenoid device selectively engageable with the solenoid device to mechanically hold the solenoid device in the pre-engaged position when the latch mechanism is in the latched position.

In a further exemplary embodiment of the electric starter system, the solenoid device includes a plunger having a notch. The latch mechanism includes a latch plunger having a latch foot shaped for selectively engaging the notch. When the latch foot is engaged with the notch when the latch mechanism is in the latched position, the solenoid device is mechanically held in the pre-engaged position.

In a further exemplary embodiment of the electric starter system, the latch mechanism includes a latch biasing member that continuously urges the latch foot out of engagement with the notch. When the solenoid device is released from the pre-engaged position after the engine is started, the solenoid biasing member moves the solenoid device to the disengaged position and the latch biasing member moves the latch solenoid device to the unlatched position wherein the latch foot is released from the notch.

In another exemplary embodiment of the electric starter system, the solenoid device has a solenoid biasing member that continuously urges the solenoid towards the disengaged position. When the solenoid device is urged out of the pre-engaged position after the engine is started and the pinion gear disengages the flywheel, the solenoid biasing member moves the solenoid device to the disengaged position.

In still another exemplary embodiment of the electric starter system, the solenoid device includes a solenoid housing having a circumferential annular first groove thereon. The solenoid device also includes a plunger having a segmented annular second groove thereon. A ball is positioned and trapped between the first and second grooves.

In accordance with yet another exemplary embodiment of the electric starter system, the segmented annular second groove has one or more short V-shaped segments. The segmented annular second groove also has one or more long V-shaped segments. When the solenoid device is in the pre-engaged position, the ball is positioned in one of the long V-shaped segments such that the pinion gear is engaged with the flywheel, and when the solenoid device is in the disengaged position, the ball is positioned in one of the short V-shaped segments such that the pinion gear is disengaged from the flywheel.

In yet a further exemplary embodiment of the electric starter system, the engine has an engine speed. A controller is in communication with the solenoid device and the starter motor. The controller is configured to command, in response to the engine speed being less than a threshold speed, a control current to the solenoid device at a level sufficient for moving the solenoid device to the pre-engaged position and translating the pinion gear into contact with the flywheel. The controller is also configured to command rotation of the starter motor by a predetermined angle to thereby fully engage the pinion gear with the flywheel, command the control current to the latch mechanism at a level sufficient to move the latch mechanism to the latched position when the solenoid device is in the pre-engaged position, and command the end of the control current to the solenoid device and latch mechanism once the latch mechanism is in the latched position whereby the latch mechanism mechanically holds the solenoid device in the pre-engaged position after the control current is ended.

In accordance with yet another embodiment of the electric starter system, the latch mechanism includes a latch solenoid device. The controller is configured to command, in response to the engine speed being less than a threshold speed, a control current to the latch solenoid device at a current level sufficient for moving a latch plunger of the latch solenoid device to the latched position.

In accordance with another example in the present disclosure, a powertrain includes an internal combustion engine having an engine speed and a flywheel, a transmission connected to the engine, a load coupled to the transmission, and an electric starter system for use with the engine. The electric starter system includes a pinion gear and a solenoid device coupled to the pinion gear. The solenoid device is movable between a pre-engaged position when the pinion gear is moved into engagement with the flywheel, and a disengaged position when the pinion gear is disengaged from the flywheel. A brushless starter motor is selectively connectable to the flywheel of the engine via the pinion gear during a requested engine start event. A latch mechanism is selectively engageable with the solenoid device. The latch mechanism is moveable between a latched position in which the solenoid device is mechanically held in the pre-engaged position, and an unlatched position in which the solenoid device is released for movement to the disengaged position. When the latch mechanism is in the latched position, the solenoid device is mechanically held in the pre-engaged position with the pinion gear engaging the flywheel and ready to start the engine.

In a further exemplary embodiment of the powertrain, the solenoid device includes a plunger and a solenoid biasing member for biasing the plunger towards a disengaged position. When the latch mechanism is in the unlatched position, the solenoid biasing member urges the solenoid device to the disengaged position.

In another exemplary embodiment of the powertrain, the latch mechanism includes a latch solenoid device selectively engageable with the solenoid device.

In accordance with another example, a method for controlling an electric starter system for an internal combustion engine having an engine speed and a flywheel is disclosed. The method includes being responsive to a requested start of the engine determining, via a controller, when the engine speed is less than a threshold speed, being responsive to the engine speed being less than the threshold speed, and commanding delivery of a control current to a solenoid device via the controller at a current level sufficient for moving the solenoid device to a pre-engaged position wherein a pinion gear operatively connected to the solenoid device moves into engagement with the flywheel. The method further includes commanding rotation of a brushless starter motor by a predetermined angle to thereby fully engage the pinion gear with the flywheel, and commanding movement of a latch mechanism into a latched position whereby the latch mechanism is engaged with the solenoid device such that the solenoid device is mechanically held in the pre-engaged position for operative connection with the pinion gear translated for continued contact with the flywheel. The method further includes ending delivery of current to the solenoid device after the latch mechanism is in the latched position whereby when the current is ended, the latch mechanism mechanically holds the solenoid device in the pre-engaged position wherein the pinion gear is in contact with the flywheel without continued delivery of current.

In another exemplary embodiment, the latch mechanism includes a latch solenoid device, and the method further includes energizing the latch solenoid device such that a latch plunger moves into engagement with the solenoid device prior to ending delivery of current.

In a further exemplary embodiment of the method, the solenoid device includes a solenoid biasing member continuously urging the solenoid device towards a disengaged position.

In yet another exemplary embodiment of the method, the latch solenoid device includes a latch biasing member continuously urging the latch plunger towards a disengaged position.

In still another exemplary embodiment of the method, after the engine is started, the pinion gear is disengaged from the flywheel such that the solenoid device is moved to a disengaged position as urged by the solenoid biasing member and the latch solenoid device is moved to an unlatched position as urged by the latch biasing member.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

Figure 1:
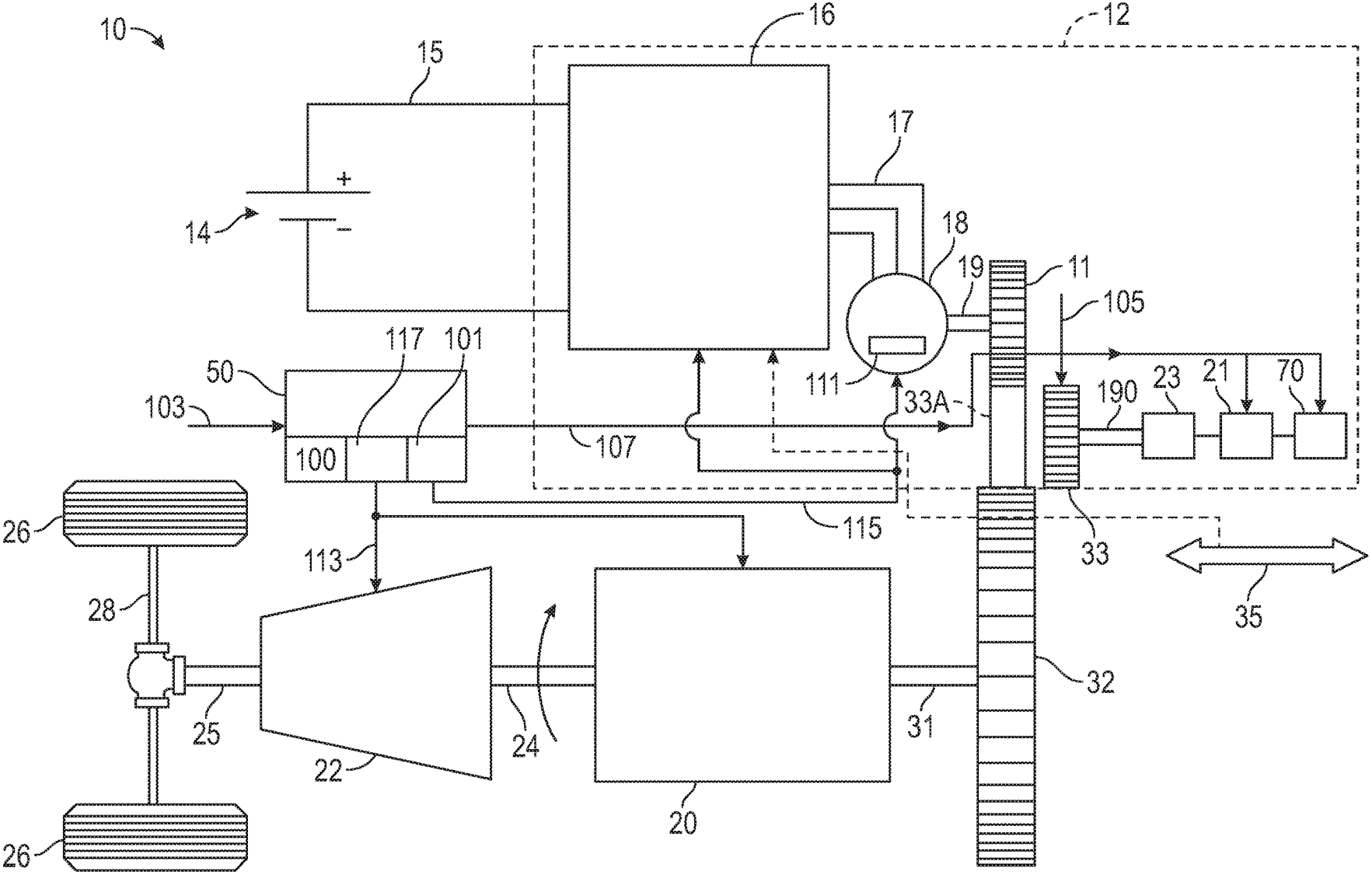
FIG. 1 is a schematic illustration of a powertrain having an exemplary electric starter system for an engine, with the electric starter system including a brushless starter motor, a pinion gear, a solenoid device, and a latch mechanism that are collectively controlled during an engine start event.

The above features and advantages, and other features and advantages of the disclosure are readily apparent from the following detailed description when taken in connection with the accompanying drawings.

DETAILED DESCRIPTION

The following description is merely exemplary in nature and is not intended to limit the present disclosure, its application or uses. It should be understood that throughout the drawings, corresponding reference numerals indicate like or corresponding parts and features. Those having ordinary skill in the art will recognize that terms such as "above," "below," "upward," "downward," "top," "bottom," etc., are used descriptively for the figures, and do not represent limitations on the scope of the invention, as defined by the appended claims.

In an exemplary embodiment, a powertrain 10 is shown schematically in FIG. 1 having an engine 20 coupled via a crankshaft 31 to a flywheel 32, e.g., to a ring gear or other drive mechanism connected thereto. The powertrain 10 also includes an electric starter system 12 operable for automatically cranking and starting the engine 20 during a requested engine auto-start event, for instance after the engine 20 has been turned off at idle or turned off when parked.

The electric starter system 12 as disclosed herein includes a poly-phase/alternating current (AC) brushless electric machine, hereinafter referred to as starter motor 18. As such, the starter motor 18 employs an electronic commutator using solid-state switches to provide cranking torque in support of a start-stop function of the engine 20. The starter motor 18 includes a rotor 19 coupled to a planetary gear system 11, e.g., a ring gear and/or one or more gear elements. The electric starter system 12 also includes a solenoid device 21 connected to a lever 23 coupled to a pinion gear 33 via a shaft 190, with the pinion gear 33 able to be selectively engaged with the flywheel 32 via operation of the solenoid device 21. The electric starter system 12 also includes a latch mechanism 70 which is selectively engageable with the solenoid device 21 for maintaining the solenoid device 21 in a pre-engaged position without continuous power consumption, as described further hereinafter.

As explained in further detail below with reference to FIGS. 4 and 5, a controller 50, such as an engine control module in an exemplary vehicle embodiment, is configured to execute a method 100 in the overall control of a torque operation of the starter motor 18. This occurs during and after the auto-start event of the engine 20. The solenoid device 21 and the latch mechanism 70 enable extended periods of pre-engagement of the pinion gear 33 with the flywheel 32 during auto-stop/start events of the engine 20 and during a full engine shutdown for restart with a key without power consumption during the extended periods of pre-engagement, as described further herein.

In particular, the controller 50 executes logic embodying the method 100 as part of a pinion pre-engagement scheme when the engine 20 is in an auto-stop mode and engine rotational speed is below a calibrated threshold speed. The latch mechanism 70 is energized and set to a latched position which holds solenoid device 21 in a pre-engaged position wherein the pinion gear 33 is engaged with the flywheel 32, and thus with the engine 20, until a commanded restart operation of the engine 20 using the brushless starter motor 18 is complete. After the latch mechanism 70 is in the latched position, the controller 50 may stop delivering any level of voltage or current that is supplied to the solenoid device 21 and to a latch solenoid device 71. In such state, the latch mechanism 70 mechanically holds the solenoid device 21 in the pre-engaged position without continuous supply of power, as described herein. In this manner, the solenoid device 21 in the pre-engaged position holds the pinion gear 33 in meshed engagement with the flywheel 32, e.g., with a splined or toothed gear member connected thereto, without continuously powering the solenoid device 21. Motor torque from the starter motor 18 may also be used to control rotation of the pinion gear 33 in a manner that ensures full seating of the pinion gear 33 on the planetary gear system 11. In this manner, the approach described herein is intended to help eliminate noise, vibration, and harshness due to sub-optimal gear meshing during the auto-start event.

Further with respect to the powertrain 10 and electric starter system 12 shown in FIG. 1, the engine 20 may be embodied as a gasoline or diesel engine, and ultimately outputs engine torque to an output shaft 24. The output shaft 24 may be coupled to a transmission 22, e.g., via a hydrodynamic torque converter or clutch (not shown). The transmission 22 ultimately delivers output torque at a particular gear or speed ratio to a transmission output member 25. The output member 25 in turn drives a coupled load via one or more drive axles 28, with the load depicted in FIG. 1 being a set of drive wheels 26 in an example automotive application. Other beneficial applications for the powertrain 10 may be envisioned, including power plants, robotics, mobile platforms, and non-motor vehicle applications such as watercraft, marine vessels, rail vehicles, and aircraft, and therefore the motor vehicle embodiment of FIG. 1 is intended to be illustrative of the disclosed concepts without limitation.

When the engine 20 is not running, such as after a fuel-conserving auto-stop event of the engine 20 at idle or when cruising with the engine 20 turned off, the electric starter system 12 may be electrically and automatically energized in response to control signals sent to the solenoid device 21 from the controller 50 so as to selectively deliver starting motor torque to the flywheel 32. One possible configuration for achieving such end is the use of the solenoid device 21 situated as depicted in FIG. 1. The solenoid device 21 may include the shaft 190, with the lever 23 located between the shaft 190 and the solenoid device 21.

Figure 2A:
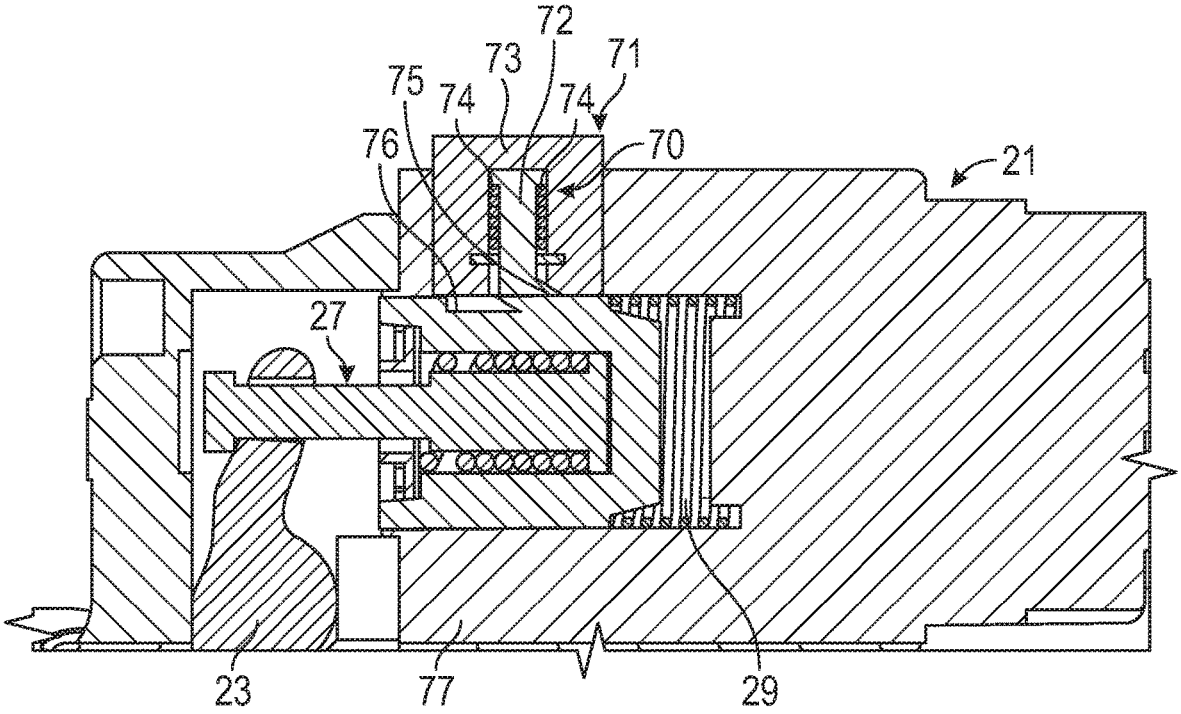
FIG. 2A is a schematic cross-sectional view of a portion of an electric starter system with a solenoid device in a disengaged position and a latch mechanism in an unlatched position.
Figure 2B:
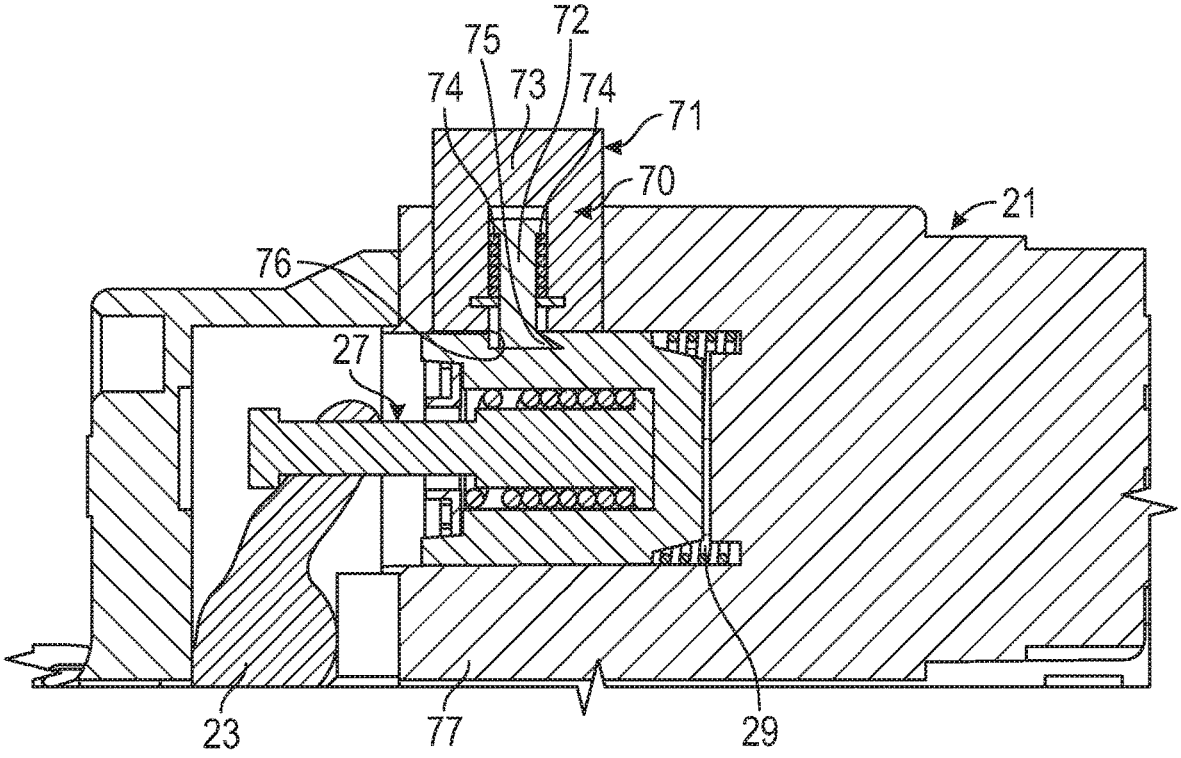
FIG. 2B is a schematic cross-sectional view of a portion of an electric starter system with a solenoid device in a pre-engaged position and a latch mechanism in a latched position.

With reference to FIGS. 2A and 2B, the solenoid device 21 includes a solenoid plunger 27 connected to the lever 23. The solenoid device 21 also includes a solenoid biasing member 29 and a plunger housing 77. As shown in FIG. 2A, the solenoid device 21 has a disengaged or off position wherein the plunger 27 is in a forward position and the lever 23 is rotated to a position wherein the connected pinion gear 33 is moved to a position disengaged from the flywheel 32, as shown in FIG. 1.

As shown in FIG. 2B, when the solenoid device 21 is energized in response to the solenoid control signals from the controller 50 that energize a coil (not shown), the solenoid device 21 is moved to a pre-engaged position wherein the plunger 27 compresses the solenoid biasing member 29. In this engaged position, the plunger 27 of the solenoid device 21 linearly translates and then moves the lever 23 and shaft 190 such that the pinion gear 33 is in the engaged position indicated at 33A of FIG. 1. Thus, the pinion gear 33 comes into direct contact and meshed engagement with mating teeth or splines on both the flywheel 32 and the planetary gear system 11.

In accordance with the present disclosure as shown in FIGS. 2A and 2B, the exemplary latch mechanism 70 includes the latch solenoid device 71 which advantageously may be significantly smaller than the primary solenoid device 21. The latch solenoid device 71 includes a latch plunger 72, a latch housing 73, a latch biasing member 74, and a latch coil assembly (not shown). The latch plunger 72 includes a latch foot 75 having a hook-like shape for engagement with a notch 76 on the plunger 27. When the coil assembly of the latch solenoid device 71 is energized, the latch plunger 72 is urged downward. Accordingly, the latch foot 75 slides into and engages with the notch 76 on the plunger 27 of the solenoid device 21. This occurs when the notch 76 is moved past the latch foot 75 when the solenoid device 21 is energized and the plunger 27 moves inward to the pre-engaged position and the latch solenoid device 71 is energized and the latch plunger 72 moves downward to the latched position. It will be appreciated that the notch 76 and latch foot 75 are exemplary and could be any mating shapes that securely and releasably engage the latch plunger 72 in the notch 76 of the solenoid device 21. It will be appreciated that the latch biasing member 74 continuously urges the latch plunger 72 upward or away from the notch 76 to the unlatched or off position of the latch mechanism 70.

Once the engine 20 has started, the pinion gear 33 is urged out of engagement with the flywheel 32 via a return action of the solenoid device 21 wherein the solenoid biasing member 29 urges the solenoid device 21 to the disengaged or off position. When the plunger 27 of the solenoid device 21 moves forward to the disengaged or off position, it will be appreciated that the latch foot 75 of the latch plunger 72 pops out of the notch 76 as the plunger 27 moves forward. Thus, the latch mechanism 70 moves into the unlatched or off position shown in FIG. 2A. It will be appreciated that this occurs when the notch 76 is moved past vertical alignment with the latch plunger 72 as the latch biasing member 74 is constantly biasing the latch plunger 72 in an upward direction towards the unlatched or off position.

When the engine 20 reaches below a threshold speed indicating that the engine 20 will be in a condition requiring a start or restart, the controller will send a signal to both the solenoid device 21 and the latch solenoid device 71 to reset the solenoid device 21 to the pre-engaged position and to reset the latch mechanism 70 to the latched condition whereby the pinion gear 33 engages the flywheel 32 and the electric starter system 12 is ready to start or re-start the engine 20 when requested by the controller 50. As will be described in detail with respect to FIGS. 4 and 5, when the solenoid device 21 and the latch solenoid device 71 are both briefly energized to reset to the pre-engaged condition, the solenoid device 21 is energized and moved to compress the solenoid biasing member 29 and the latch solenoid device 71 is energized such that the latch plunger 72 is urged to move down to the on or latched position as shown in FIG. 2B. Thus, as the notch 76 passes by the latch plunger 72, the latch foot 75 securely engages the notch 76. Advantageously, as soon as the pinion gear 33 is finished aligning and meshing with the flywheel 32, the power to the electric starter system 12, including the solenoid device 21 and the latch solenoid device 71 may be discontinued. Advantageously, the solenoid device 21 and pinion gear 33 remain in this pre-engaged position without the consumption of any power since the solenoid device 21 is now mechanically held in the pre-engaged position by the latch mechanism 70 in the latched position.

It will be appreciated that other configurations may exist for selectively engaging the pinion gear 33 with the flywheel 32 and planetary gear system 11, and therefore the illustrated embodiment is intended to be illustrative of the general concepts disclosed herein without limiting the electric starter system 12 to such an embodiment.

Figure 3A:
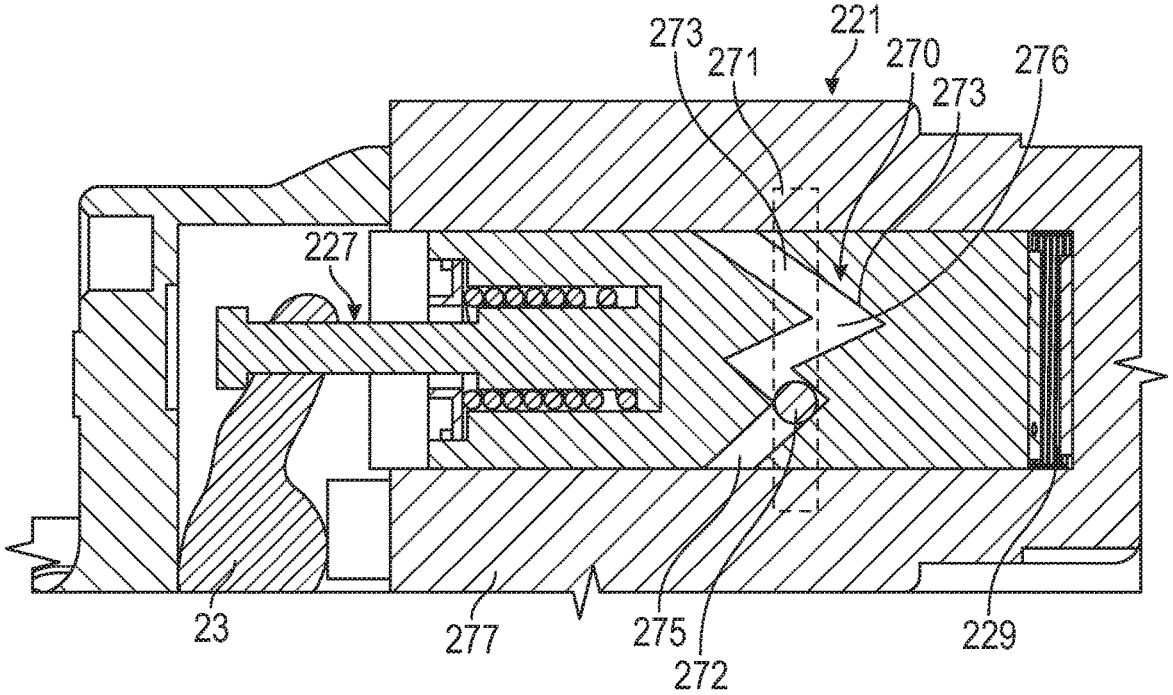
FIG. 3A is a schematic cross-sectional view of a portion of an electric starter system with a solenoid device in a pre-engaged position and a latch mechanism in a latched position.
Figure 3B:
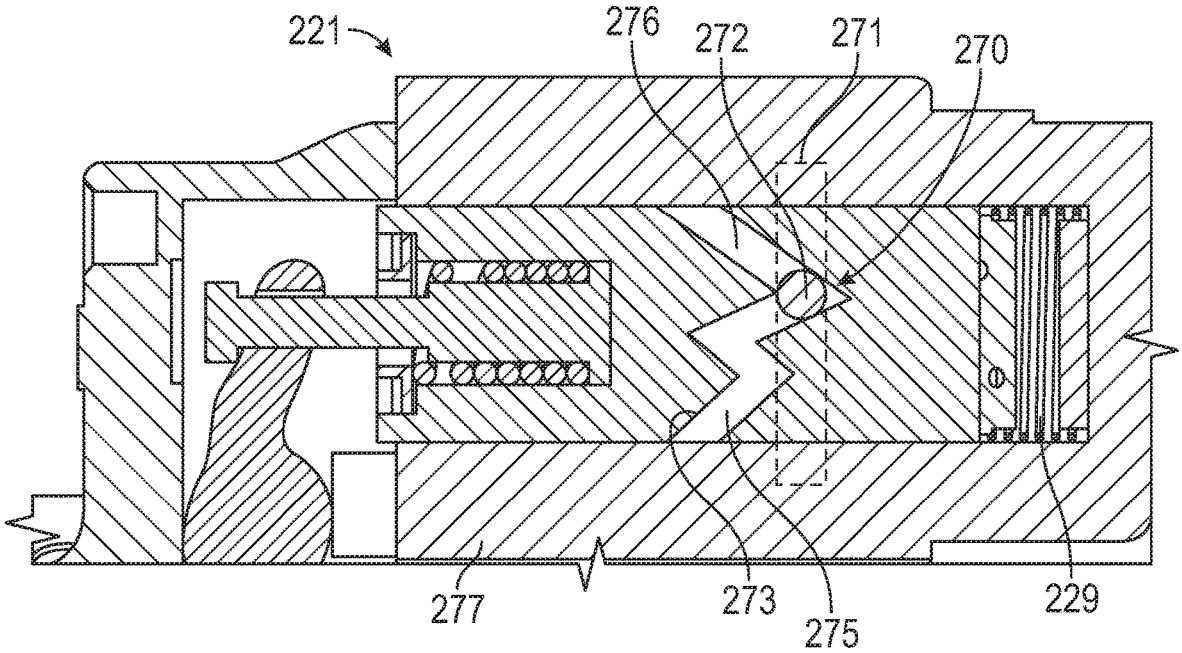
FIG. 3B is a schematic cross-sectional view of a portion of an electric starter system with a solenoid device in a disengaged position and a latch mechanism in an unlatched position.

With reference to FIGS. 3A and 3B, another exemplary latch mechanism 270 is shown that operates in a mechanical manner without any additional small electronic solenoid device. The solenoid device 221 includes a plunger 227 connected to lever 23. The solenoid device 221 also includes a solenoid biasing member 229 and a plunger housing 277. As shown in FIG. 3B, the solenoid device 221 has a disengaged or off position wherein the plunger 227 is in a forward position and the lever 23 is rotated to a position wherein the connected pinion gear 33 is disengaged from the flywheel 32, as shown in FIG. 1.

As shown in FIG. 3A, when the solenoid device 221 is energized in response to the solenoid control signals from the controller 50, the solenoid device 221 is moved to an on or pre-engaged position wherein the plunger 227, in response to an energized coil (not shown), compresses the solenoid biasing member 229. In this engaged position, the plunger 227 of the solenoid device 221 linearly translates and thus moves the lever 23 and shaft 190 such that the pinion gear 33 is in the position indicated at 33A of FIG. 1, and thus in direct contact and meshed engagement with mating teeth or splines on both the flywheel 32 and the planetary gear system 11.

A latch mechanism 270 includes a straight annular groove 271 on the plunger housing 277, a ball 272, and a segmented grooved 273 on the plunger 227. The segmented groove 273 has a shorter first V-shaped segment 275 and longer second V-shaped segment 276. It will be appreciated that the segmented groove 273 with the shorter first V-shaped segment 275 and the longer second V-shaped segment 276 is provided annularly around the plunger 227 in a repeating pattern two or more times, such as by machining. It will be appreciated that the ball 272 is a smooth metal ball, such as a bearing, that is trapped between the annular groove 271 and the segmented groove 273. The solenoid biasing member 229 continuously urges the plunger 227 towards the disengaged or off position.

As shown in FIG. 3A, when the coil assembly (not shown) of the solenoid device 221 is energized, the plunger 227 is urged inward and compresses the solenoid biasing member 229 such that the ball 272 engages with the longer second V-shaped segments 276 and permits the plunger 227 to move to the off or disengaged position. It will be appreciated that each time the solenoid device 221 is energized, the ball 272 moves circumferentially around the annular groove 271. Thus, the latch mechanism 270 alternates between the on or latched position wherein the ball 272 is seated in one of the shorter first V-shaped segments 275 of the segmented groove 273 such that the solenoid device 221 is held in the on or pre-engaged position, shown in FIG. 3A, and the off or unlatched position wherein the ball 272 is seated in one of the longer second V-shaped segments 276 of the segmented groove 273 such that the solenoid device 221 is released to the off or disengaged position, shown in FIG. 3B.

While exemplary latch mechanisms 70 and 270 have been shown, it will be appreciated that other configurations of latch mechanisms may selectively engage and mechanically hold the solenoid device 21, 221 in the pre-engaged position. Therefore, the disclosed embodiments are intended to be illustrative of the general concepts disclosed herein without limiting the electric starter system 12 to such particular embodiments.

Referring to FIG. 1 and with reference to the embodiment of FIGS. 2A and 2B, the electric starter system 12 may include or may be connected to a direct current (DC) battery pack 14, e.g., a multi-cell lithium ion, nickel metal hydride, or lead acid battery pack having positive (+) and negative (−) terminals. The battery pack 14 may be an auxiliary battery pack, e.g., having a nominal voltage at auxiliary levels, e.g., about 12-15 VDC. Thus, in a vehicular embodiment of the powertrain 10 the solenoid device 21 may be powered by a DC or pulse width modulated voltage generated by the controller 50. The controller 50 may be electrically connected to the solenoid device 21, the latch solenoid device 71, and the brushless starter motor 18 over separate control lines in a possible embodiment, with each control line possibly having a voltage level up to the voltage level of the battery 14.

The electric starter system 12 may include the power inverter module (PIM) 16, which in turn is electrically connected across the positive (+) and negative (−) terminals of the battery pack 14 via a DC voltage bus 15, as well as to a poly-phase/alternating current (AC) voltage bus 17. While shown separately from the starter motor 18 for illustrative clarity, the PIM 16 and starter motor 18 may be an integrated assembly. Although omitted from FIG. 1 for illustrative simplicity, the PIM 16 includes semiconductor switching pairs, typically MOSFETs, which are connected to positive (+) and negative (−) terminals via the DC voltage bus 15, and signal filtering circuit components which ultimately convert DC power from the battery pack 14 into poly-phase power on the AC voltage bus 17.

In turn, the AC voltage bus 17 is electrically connected to individual phase windings internal to the brushless starter motor 18. The starter motor 18 may be configured such that a calibrated back electromotive force results for a given performance range, e.g., 3-5V at 6000 RPM, or other values ensuring that sufficient motor torque indicated at 105 is available for starting the engine 20. The starter motor 18 may be variously configured as a surface permanent magnet machine, an internal permanent magnet machine, a drag-cup induction machine, a switched reluctance machine, or another type of brushless motor without limitation. As recognized herein, brushless motors such as the starter motor 18 may enjoy an extended operating life with an improved level of speed control precision relative to certain brush-type motors, among other possible benefits.

The controller 50 of FIG. 1 is configured to receive measured voltage, current, position, temperature, and/or other suitable electrical value as part of a set of input signals indicated at 103. The controller 50 may be variously implemented as one or more control devices collectively managing the motor torque indicated at 105 from the starter motor 18 as part of the method 100. The controller 50 is configured to control the solenoid device 21 via solenoid control signals 107 and, at the same time, enable and energize the starter motor 18 via motor control signals indicated at 115 with the solenoid control signals 107 and motor control signals 115 possibly being transmitted over separate control lines or transfer connectors.

Multiple controllers may be in communication via a serial bus, e.g., a CAN bus 35, other differential voltage networks, or via discrete conductors. The solenoid device 21 may be responsive to a solenoid driver circuit, which may reside in the controller 50 or the PIM 16 in different embodiments. In this manner, the controller 50 may either control the solenoid device 21 directly or may merely enable control of the solenoid device 21, e.g., by the PIM 16 and/or a motor control processor 111 of the starter motor 18.

The controller 50 may include one or more digital computers each having a processor 101, e.g., a microprocessor or central processing unit, as well as memory 117 in the form of read only memory, random access memory, electrically-programmable read only memory, etc., a high-speed clock, analog-to-digital and digital-to-analog circuitry, input/output circuitry and devices, and appropriate signal conditioning and buffering circuitry. The controller 50 may also store algorithms and/or computer executable instructions in memory 117, including the underlying algorithms or code embodying the method 100 described below, and transmit commands to the electric starter system 12 to enable performance of certain control actions according to the present disclosure. While voltage control functions are depicted as being conducted by the controller 50, it is also possible to integrate voltage control of the solenoid device 21 into the motor control processor 111 of the starter motor 18 for pre-engaging of the pinion gear 33 via communication between the controller 50, e.g., a powertrain control unit, and the motor control processor 111.

The controller 50 is in communication with the engine 20 and receives, as part of the input signals 103, signals indicative of a speed and temperature of the engine 20, as well as other possible engine operating conditions or parameters. Such parameters include a starting request of the engine 20, whether operator-initiated or autonomously generated. The controller 50 is also in communication with the starter motor 18, and thus receives signals indicative of current speed, current draw, torque, temperature, and/or other operating parameters. The controller 50 may also communicate with the battery pack 14 and receive signals indicative of a battery state of charge, temperature, and current draw, as well as a voltage across the respective DC and AC voltage buses 15 and 17. In addition to transmitting a torque request to the starter motor 18 via the solenoid control signals at 107, the controller 50 may also transmit output signals indicated at 113 to the engine 20 and transmission 22 as part of the overall operating function of the controller 50.

Figure 5:
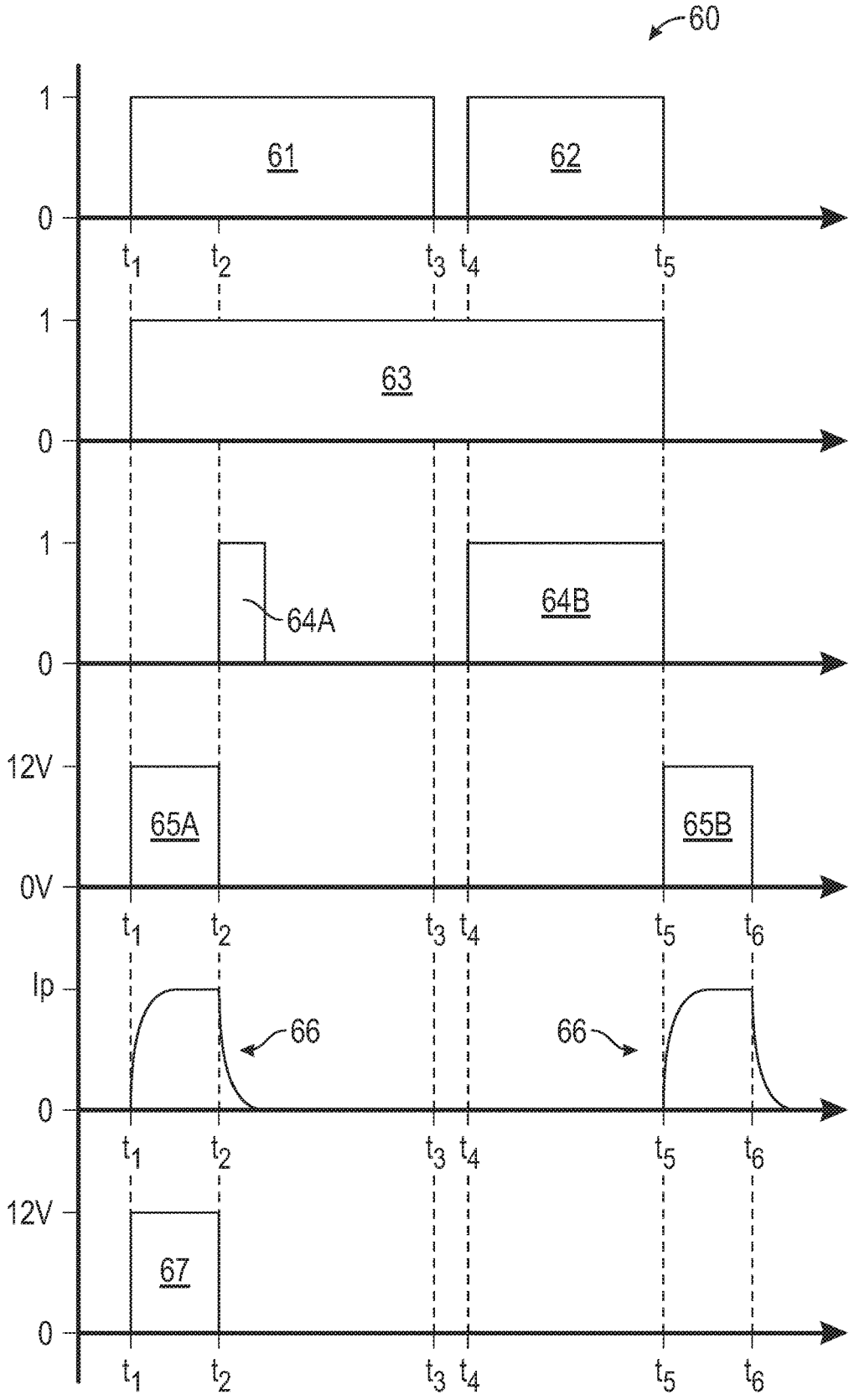
FIG. 5 is a time plot of various bit flags and nominal control values usable in the overall control of the electric starter system shown in FIG. 1.

Referring to traces 60 of FIG. 5, as part of the method 100, the controller 50 is configured to set an engine start flag, e.g., a binary 1 or 0 bit flag, to enable the starter motor 18 and the solenoid device 21 to be controlled in a subsequent engine start event after an auto-stop or other stop condition. Control parameters evaluated as part of the method 100 may include bit flags 61 and 62. Bit flag 61 of FIG. 5 corresponds to an active auto-stop condition in which the engine 20 of FIG. 1 is in an off state, i.e., is not running, and engine speed is less than a threshold speed. This condition extends from about t1 to t3 in FIG. 5. Bit flag 62 is then sent high, e.g., to binary 1 as shown, when the controller 50 commands restart of the engine 20, which commences at t4 and continues until t5.

At t1, the controller 50 sets another bit flag 63 indicating that pre-engagement of the pinion gear 33 is enabled in logic of the controller 50. This pinion-enabled state continues until completion of the restart event at t5. At t5, the pinion gear 33 disengages. At t2, which is reached shortly after enabling the solenoid device 21, the controller 50 also enables energizing of the starter motor 18, as indicated by bit flag 64A. Thus, bit flags 61, 62, 63, 64A, and 64B correspond to TRUE/FALSE logic states in which a high value (e.g., 1) is TRUE and a low value (0) is FALSE.

Also shown in FIG. 5, voltages 65A and 65B are applied to energize the coil of the solenoid device 21 which vary between 0V and 12V in a nominal 12V auxiliary embodiment of the DC voltage bus 15. Thus, between t1 and t2 at an initial pre-engagement of the solenoid device 21 and the latch solenoid device 71 prior to enabling the starter motor 18, the full bus voltage is delivered to the solenoid device 21 and latch solenoid device 71, as indicated by the applied voltages 65A and 67. Applied voltage 65A of predetermined duration T1=t2−t1 is sufficient to cause the pinion gear 33 to overcome friction and begin to move into the engaged position.

Responsive to the applied voltage 65A is an actual coil current 66 describing the current, in amps, that is delivered to the solenoid device 21. Coil current 66 initially ramps up to a peak current (IP) starting from 0 at t1 and tapers down to zero starting at t2. It will be appreciated that the movement of the solenoid device 21 during t1 to t2 causes the latch mechanism 70, 270 and/or the latch solenoid device 71 to the move to the latched position which mechanically holds the solenoid device 21 in the pre-engaged or on position such that the solenoid device 21 continues to hold the pinion gear 33 of FIG. 1 in an engaged state with the flywheel 32 without requiring any power consumption by the latch mechanism 70, 270 or the solenoid device 21, 221 and without any possibility of overheating the solenoid device 21, 221 during the entire time from t1 until t5. Advantageously, it will be appreciated that the solenoid device 21, 221 is mechanically held in the pre-engaged position by the latch mechanism 70, 270 even when the engine 20 is turned completely off with no power from the battery 15 such that the starter system 12 enables sustained engagement of the pinion gear 33 ready for a key start.

As noted above with reference to FIG. 1, the solenoid device 21 may be supplied by the controller 50 or the motor control processor 111 with a pulse width modulated voltage at a level that enables soft engagement of the pinion gear 33 with the flywheel 32 during an auto-stop condition of the engine 20. The on-duration and movement of the starter motor 18 during the auto-stop phase may be controlled in response to setting of the bit flag 64A to complete full seating of the pinion gear 33 on the planetary gear system 11 of FIG. 1. During restart of the engine 20, the starter motor 18 is controlled to deliver maximum power for restart with minimal delay, as the pinion gear 33A is already in a fully seated position with respect to the planetary gear system 11. Once the engine 20 has fully restarted, the controller 50 terminates the engine start signal at about t5 of FIG. 5, as shown via bit flag 62. The controller 50 also terminates the motor control signal when motor speed reaches a predetermined value or when the engine start signal is terminated, whichever comes first. The starter motor 18 is then shut down.

To release the latch foot 75 of the latch mechanism 70 from the latched position, the solenoid device 21 is once again energized as indicated by applied voltage 65B (t5 to t6) of similar duration as 65A, which moves the plunger 27 forward enough to enable the latch biasing member 74 of the latch solenoid device 71 to return the latch plunger 72 to the unlatched position as the latch foot 75 is pulled up out of the notch 76.

Figure 4:
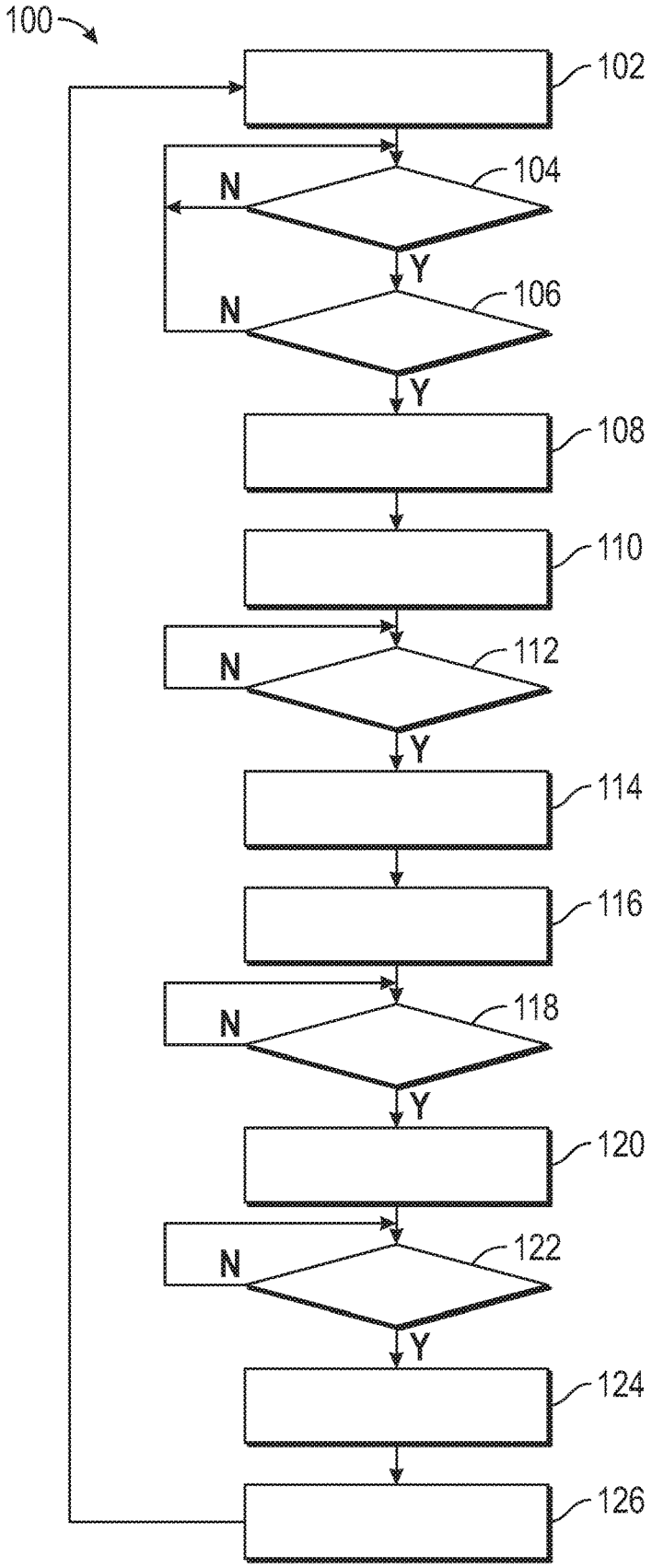
FIG. 4 is a flow chart describing an exemplary embodiment of a method for controlling pre-engagement of a pinion gear and an engine during a representative engine start event using an electric starter system.

Referring to FIG. 4, the method 100 according to an example embodiment commences at step 102 with the engine 20 of FIG. 1 in an on/running state. The method 100 proceeds to step 104 with the engine 20 running.

Step 104 includes determining whether auto-stop of the engine 20 has been enabled. For instance, the controller 50 may determine, via its internal logic, whether operating conditions call for stopping the engine 20, e.g., when a vehicle having the powertrain 10 of FIG. 1 is at a stop light or otherwise idling. Step 104 is repeated until a determination by the controller 50 is made that auto-stop is enabled, at which point the controller 50 proceeds to step 106.

Step 106 includes comparing engine speed (N20) to a calibrated threshold speed (N1). The method 100 proceeds to step 108 when engine speed is less than the calibrated threshold speed, i.e., N20<N1. Otherwise, the controller 50 repeats step 106.

At step 108, with engine speed below the calibrated threshold speed at step 106, the controller 50 enables both the solenoid device 21 and latch solenoid device 71, as indicated by rising edge of bit flag 63 of FIG. 5. The method 100 then proceeds to step 110.

At step 110, the controller 50 applies voltage 65A to solenoid device 21 and voltage 67 to latch solenoid device 71 of the latch mechanism 70 as shown in traces of FIG. 5. At this same time from t1 to t2, it will be appreciated that the latch mechanism 70 is moved to the latched position by the application of voltage 67 to the small coil of the latch solenoid device 71 of the latch mechanism 70. It will be appreciated that in the alternate embodiment of FIGS. 3A and 3B, the application of the voltage 65A to the solenoid device 221 disengages ball 272 to move to a longer second V-shaped segment 276 such that latch mechanism 270 is in an unlatched position. In this alternate embodiment of FIGS. 3A and 3B, there is no small solenoid so the voltage 67 is not used. The method 100 then proceeds to step 112.

Step 112 includes initiating a counter (T) of the controller 50 and waiting for a calibrated duration of delay (T1), with T1 being a predetermined duration suitable for allowing the pinion gear 33 to overcome friction and start to move, with the ultimate goal of achieving contact between the pinion gear 33 and the flywheel 32, i.e., achievement of the pre-engaged state. The method 100 proceeds from step 112 to step 114 when T>T1.

Step 114 may entail enabling the brushless starter motor 18 of FIG. 1 to rotate by a preset angle suitable for fully and smoothly meshing the planetary gear system 11, the pinion gear 33, and the flywheel 32. Steps 108-114 thus result in translation of the pinion gear 33 to the position indicated at 33A of FIG. 1. The method 100 then proceeds to step 116.

At step 116, the controller 50 sets the voltage for the solenoid device 21 down to zero, as shown at t2 of trace 65A in FIG. 2. Advantageously, no power delivery to the solenoid device 21, 221 is needed to hold the solenoid device 21, 221 in the pre-engaged position since the latch mechanism 70, 270 is mechanically holding the solenoid device 21, 221, and thus the pinion gear 33, in the pre-engaged position. The pinion gear 33 is held fully engaged with the flywheel 32. The method 100 then proceeds to step 118.

Step 118 includes determining whether auto start of the engine 20 has been enabled. The method 100 proceeds to step 120 when auto start is enabled, repeating step 118 until enablement has been determined.

Step 120 includes commanding the starter motor 18, via the motor control signals 115 of FIG. 1, to crank the engine 20 to a threshold starting speed, where the engine can be fueled and fired to sustain running. Step 120 may include commanding the motor torque 105 of FIG. 1 at a level sufficient for rotating the crankshaft 31. The method 100 then proceeds to step 122.

At step 122, the controller 50 determines if the auto start event is complete, a state that is achieved when engine speed (N20) exceeds a threshold speed, e.g., an idle speed of 600 RPM, for a predetermined duration such as 200 ms indicative of autostart being complete. The method 100 proceeds to step 124 when the engine 20 has successfully started.

Step 124 includes enabling, via the controller 50, the stopping of the starter motor 18. Step 124 also sets disabling the engagement of the pinion gear 33 via the starter control signals 107 of FIG. 1, as referenced at the ending edge of 63 at t5 in FIG. 5. The method 100 then proceeds to step 126.

At step 126 the full voltage is delivered to the solenoid device 21 at the time t5 as shown in trace 65B of FIG. 5. This moves the plunger 27 of the solenoid device 21 sufficiently forward, with the latch solenoid device 71 not energized, so that the latch foot 75 is moved out of the latched condition by the upward action of the latch biasing member 74 to the unlatched position. At time t6, the voltage 65B is set back to zero whereby the plunger 27 of solenoid device 21 is returned to its disengaged position by the solenoid biasing member 29 which in turn returns the pinion gear 33 to the disengaged position. The method 100 is complete, starting anew with step 102 for a subsequent auto stop event.

The method 100 may therefore be used advantageously within the context of the example powertrain 10 of FIG. 1 to improve the noise, vibration, and harshness performance of an engine start/stop system using the example brushless starter motor 18 described herein. Such benefits and other possible benefits will be apparent to one of ordinary skill in the art in view of the present disclosure.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof

What is claimed is:

1. An electric starter system for use with an engine having a flywheel, the electric starter system comprising:

a pinion gear;

a solenoid device coupled to the pinion gear, the solenoid device movable between a pre-engaged position wherein the pinion gear is moved into engagement with the flywheel and a disengaged position wherein the pinion gear is disengaged from the flywheel;

a brushless starter motor that is selectively connectable to the flywheel of the engine via the pinion gear during a requested engine start event; and a latch mechanism selectively engageable with the solenoid device, the latch mechanism moveable between a latched position wherein the solenoid device is mechanically held in the pre-engaged position and an unlatched position wherein the solenoid device is released for movement to the disengaged position whereby when the latch mechanism is in the latched position, the solenoid device is mechanically held in the pre-engaged position with the pinion gear engaging the flywheel and ready to start the engine.

2. The electric starter system of claim 1, wherein the solenoid device includes a plunger and a solenoid biasing member for biasing the plunger towards a disengaged position whereby when the latch mechanism is in the unlatched position, the solenoid biasing member urges the solenoid device to the disengaged position.

3. The electric starter system of claim 1, wherein the latch mechanism includes a latch solenoid device selectively engageable with the solenoid device to mechanically hold the solenoid device in the pre-engaged position when the latch mechanism is in the latched position.

4. The electric starter system of claim 1, wherein the solenoid device includes a plunger having a notch and wherein the latch mechanism includes a latch plunger having a latch foot shaped for selectively engaging the notch whereby when the latch foot is engaged with the notch when the latch mechanism is in the latched position, the solenoid device is mechanically held in the pre-engaged position.

5. The electric starter system of claim 4, wherein the latch mechanism includes a latch biasing member that continuously urges the latch foot out of engagement with the notch and wherein the solenoid device includes a solenoid biasing member that continuously urges the solenoid device to the disengaged position whereby when the solenoid device is released from the pre-engaged position after the engine is started, the solenoid biasing member moves the solenoid device to the disengaged position and the latch biasing member moves the latch solenoid device to the unlatched position wherein the latch foot is released from the notch.

6. The electric starter system of claim 1, wherein the solenoid device includes a solenoid biasing member that continuously urges the solenoid towards the disengaged position whereby when the solenoid device is urged out of the pre-engaged position after the engine is started and the pinion gear disengages the flywheel, the solenoid biasing member moves the solenoid device to the disengaged position.

7. The electric starter system of claim 1, wherein the solenoid device includes a solenoid housing having a circumferential annular first groove thereon and wherein the solenoid device includes a plunger having a segmented annular second groove thereon and wherein the latch mechanism includes a ball trapped for movement between the first and second grooves.

8. The electric starter system of claim 7, wherein the segmented annular second groove has one or more short V-shaped segments and wherein the segmented annular second groove has one or more long V-shaped segments whereby when the solenoid device is in the pre-engaged position, the ball is positioned in one of the long V-shaped segments such that the pinion gear is engaged with the flywheel and when the solenoid device is in the disengaged position, the ball is positioned in one of the short V-shaped segments such that the pinion gear is disengaged from the flywheel.

9. The electric starter system of claim 1, wherein the engine has an engine speed and wherein a controller is in communication with the solenoid device and the starter motor, the controller being configured to:

command, in response to the engine speed being less than a threshold speed, a control current to the solenoid device at a level sufficient for moving the solenoid device to the pre-engaged position and translating the pinion gear into contact with the flywheel;

command rotation of the starter motor by a predetermined angle to thereby fully engage the pinion gear with the flywheel;

command the control current to the latch mechanism at a level sufficient to move the latch mechanism to the latched position when the solenoid device is in the pre-engaged position; and command the end of the control current to the solenoid device and latch mechanism when the latch mechanism is in the latched position whereby the latch mechanism mechanically holds the solenoid device in the pre-engaged position after the control current is ended.

10. The electric starter system of claim 9, wherein the latch mechanism includes a latch solenoid device and wherein the controller is configured to command, in response to the engine speed being less than a threshold speed, a control current to the latch solenoid device at a current level sufficient for moving a latch plunger of the latch solenoid device to the latched position.

11. A powertrain comprising:

an internal combustion engine having an engine speed and a flywheel;

a transmission connected to the engine;

a load coupled to the transmission; and an electric starter system for use with the engine, the electric starter system having:

a pinion gear;

a solenoid device coupled to the pinion gear, the solenoid device movable between a pre-engaged position wherein the pinion gear is moved into engagement with the flywheel and a disengaged position wherein the pinion gear is disengaged from the flywheel;

a brushless starter motor that is selectively connectable to the flywheel of the engine via the pinion gear during a requested engine start event; and a latch mechanism selectively engageable with the solenoid device, the latch mechanism moveable between a latched position wherein the solenoid device is mechanically held in the pre-engaged position and an unlatched position wherein the solenoid device is released for movement to the disengaged position whereby when the latch mechanism is in the latched position, the solenoid device is mechanically held in the pre-engaged position with the pinion gear engaging the flywheel and ready to start the engine.

12. The powertrain of claim 11, wherein the solenoid device includes a plunger and a solenoid biasing member for biasing the plunger towards a disengaged position whereby when the latch mechanism is in the unlatched position, the solenoid biasing member urges the solenoid device to the disengaged position.

13. The powertrain of claim 11, wherein the latch mechanism includes a latch solenoid device selectively engageable with the solenoid device.

14. A method for controlling an electric starter system for an internal combustion engine having an engine speed and a flywheel, the method comprising:

responsive to a requested start of the engine determining, via a controller, when the engine speed is less than a threshold speed;

responsive to the engine speed being less than the threshold speed, commanding delivery of a control current to a solenoid device via the controller at a current level sufficient for moving the solenoid device to a pre-engaged position wherein a pinion gear operatively connected to the solenoid device moves into engagement with the flywheel;

commanding rotation of a brushless starter motor by a predetermined angle to thereby fully engage the pinion gear with the flywheel;

commanding movement of a latch mechanism into a latched position whereby the latch mechanism is engaged with the solenoid device such that the solenoid device is mechanically held in the pre-engaged position for operative connection with the pinion gear translated for continued contact with the flywheel; and ending delivery of current to the solenoid device after the latch mechanism is in the latched position whereby when the current is ended, the latch mechanism mechanically holds the solenoid device in the pre-engaged position wherein the pinion gear is in contact with the flywheel without continued delivery of current.

15. The method of claim 14, wherein the latch mechanism includes a latch solenoid device, and the method further includes energizing the latch solenoid device such that a latch plunger moves into engagement with the solenoid device prior to ending delivery of current.

16. The method of claim 15, wherein the solenoid device includes a solenoid biasing member continuously urging the solenoid device towards a disengaged position.

17. The method of claim 16, wherein the latch solenoid device includes a latch biasing member continuously urging the latch plunger towards a disengaged position.

18. The method of claim 17, wherein after the engine is started, the pinion gear is disengaged from the flywheel such that the solenoid device is moved to a disengaged position as urged by the solenoid biasing member and the latch solenoid device is moved to an unlatched position as urged by the latch biasing member.

* * * * *